US008156673B2

(12) United States Patent
Williams, Jr.

(10) Patent No.: US 8,156,673 B2
(45) **Date of Patent: *Apr. 17, 2012**

(54) SEPARABLE TAG FOR BAGS OR OTHER CONTAINERS

(75) Inventor: Robert E. Williams, Jr., St. Louis, MO (US)

(73) Assignee: Sev-Rend Corporation, Collinsville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/381,440

(22) Filed: Mar. 12, 2009

(65) Prior Publication Data

US 2009/0172989 A1 Jul. 9, 2009

Related U.S. Application Data

(63) Continuation of application No. 11/881,260, filed on Jul. 26, 2007, now abandoned.

(51) Int. Cl.
*G09F 3/10* (2006.01)

(52) U.S. Cl. ..... 40/675; 40/637

(58) Field of Classification Search ..... None
See application file for complete search history.

(56) References Cited

U.S. PATENT DOCUMENTS

| | | | | |
|---|---|---|---|---|
| 1,384,457 | A | 7/1921 | Fetters | |
| 2,095,195 | A * | 10/1937 | MacDonald | 40/637 |
| 2,953,865 | A | 9/1960 | Heuser | |
| 3,021,630 | A | 2/1962 | Swett, Jr. | |
| 3,863,369 | A | 2/1975 | Kinne | |
| 3,917,276 | A | 11/1975 | Green Barg | |
| 4,479,838 | A | 10/1984 | Dunsim | |
| 5,264,265 | A | 11/1993 | Kaufman | |
| 5,300,344 | A | 4/1994 | Niedecker | |
| 5,413,384 | A | 5/1995 | Principe et al. | |
| 5,560,657 | A | 10/1996 | Morgan | |
| 5,704,649 | A | 1/1998 | Small | |
| 5,732,495 | A | 3/1998 | Lowe | |
| 5,792,536 | A | 8/1998 | Whipp | |
| 5,826,356 | A | 10/1998 | Lapp | |
| 6,113,148 | A | 9/2000 | Koranda et al. | |
| 6,279,255 | B1 | 8/2001 | Larsen | |
| 6,357,798 | B1 | 3/2002 | Chess | |
| 6,382,676 | B1 | 5/2002 | Cochran et al. | |
| 7,260,909 | B2 | 8/2007 | Williams | |

* cited by examiner

*Primary Examiner* — Joanne Silbermann
(74) *Attorney, Agent, or Firm* — Paul M. Denk

(57) ABSTRACT

A separable tag for bags or other containers, each tag comprising a laminar tag-like member having a series of layers, generally an upper and lower layer, the upper layer contains print materials such as for functioning as a coupon, and its is adhesively applied but peelable from a bottom layer of the tag that is securely affixed to the packaged food product. The tags may be formed continuously, but pulled free at a line of perforation, when applied manually or by machine to the bags.

3 Claims, 2 Drawing Sheets

SEPARABLE TAG FOR BAGS OR OTHER CONTAINERS

CROSS REFERENCE TO RELATED APPLICATION

This non provisional patent application claims priority to the non provisional patent application having Ser. No. 11/881,260, which was filed on Jul. 26, 2007, which claims priority to the non provisional patent application having Ser. No. 10/688,179, which was filed on Oct. 16, 2003, which issued on Aug. 28, 2007, having U.S. Pat. No. 7,260,909, claims priority to the provisional patent application having Ser. No. 60/419,818, which was filed on Oct. 21, 2002.

BACKGROUND OF THE INVENTION

This invention relates generally to a laminar tag that is separable, and can display coupon terminology, advertisement, bar code, or any other marketing information that desirably is applied to the bag or container, but which laminar tag can be separated, as when used as a coupon, for the benefit of the customer.

The variety of tags, and labels, or other informational displaying labeling material have long been utilized in the art, and appended either directly to their containers, or clipped onto the upper crimped or twisted edges of their bags, after the products have been supplied therein by the manufacturer.

For example, the patent to Swett, Jr., U.S. Pat. No. 3,021,630, shows a marking device for application to a fowl, or the like. It includes a marking apparatus, which receives a labeling strip; the label is brought into the vicinity of the limb of the fowl, as noted, and appended thereto as a printed tag that displays indicia or other pertinent information relative to the chicken or other fowl being processed.

The patent to Dunsirn, et al., U.S. Pat. No. 4,479,838, shows a Coupon Structure and Method of Using the Same. As disclosed, the coupon includes a removable top sheet, and apparently upon which the coupon print is applied. A second layer includes a transparent layer of dry residue adhesive. There is then applied a pressure sensitive layer, which apparently allows for the coupon to be applied to the surface of the carton, as noted.

The patent to Niedecker, U.S. Pat. No. 4,300,344, discloses a Tag Strip with Perforations and Staple Engaging Means. This does not show a separable type of coupon, but it does disclose a type of tag that can be crimped or applied to the upper end of a bag, once filled.

The patent to Principe, et al., U.S. Pat. No. 5,413,384, shows a Composite Label for Use in Couponing. The composite label-includes a sheet of printable label material, a sheet of underlay material, a coating of adhesive releaseably adhering the label material to the underlay, and includes printed indicia on the underlay material, and a coating of pressure sensitive adhesive on the underside of the underlay material, in forming the tag. Multiple laminations of material are required to complete the composite label of this disclosed invention.

The patent to Morgan, U.S. Pat. No. 5,560,657, shows a Tamper-Indicating Label.

The patent to Lowe, et al., U.S. Pat. No. 6,732,495, shows a Twist Tie Article. It is a tag for applying to the upper end of produce, such as the carrots as noted.

The patent to Lapp, U.S. Pat. No. 5,826,356, shows a Retail Promotion Display and Coupon System for Food and Beverage Containers. This device is for sliding over the top of a bottle, by extending the neck of the bottle through an opening in the system, as rioted.

The patent to Larsen, U.S. Pat. No. 6,279,255, shows a Banding and Tagging Method for Products.

The patent to Cochran, et al., U.S. Pat. No. 6,382,676, shows a Hand Tag with Detachable Coupon Portion. This particular tag is a form of hanger, has a thin flat sheet of synthetic resin material, a coupon thereon, but the coupon is joined by a perforated joint, where it is inserted.

These are examples of what the prior art discloses relative to the subject matter of this current invention.

SUMMARY OF THE INVENTION

The tag of this current invention is designed for usage for coupons, manufacturer's rebates, cross branding, recipes, and promotional advertisement, through the application of this type of information to the tag, with the tag then being applied to a bag or container, as will be understood.

It has not been seen, in the prior art as described herein, where a tag can be clipped to a bag, and have a top layer that can be separated from a bottom layer. The tag of this current invention includes a neck portion, and a wider portion therebelow, generally identified as the tag body. The neck portion is gripped or attached under a clip, wire tie, staple, or heat sealed, directly to the upper end of the crimped bag, and held securely to the product. The body of the tag is for use for printed indicia or other information, of the type as previously referred to herein.

The neck portion of the tag, at its upper end, will have a series of perforations, to provide a tear area for the series of tags. Also, the tag can be cut from tag to tag. Generally, the tags are formed, as by stamping or cutting, from a strip of material, to provide a series of linked tags, in a roll, for use by machinery or manually for application to the bags, during their closure. At the upper end of the neck portion of each tag there are provided a series of perforations, to allow for separation of the tags, as applied.

The bottom layer of the tag will be formed of paper, or related material. It may also be formed of plastic, or other synthetic printable material. The bottom layer will have a release coat or polymer adhesive applied to it. This allows for the application of a top layer, to the bottom layer, during the initial formation of the roll of paper stock, before it is formed into the tags.

The top layer has a line of severance approximately at its top edge, between it and the portion of the top layer that overlies the neck portion of the tag. Thus, this top layer, overlying the body portion of the tag, can be peeled off, because the adhesive that is applied is a release coat, which easily allows for the top layer to be peeled off, as desired. The top layer of the tag can be printed with information in the category of coupon, UPC price reductions, other printable information such as menus, as for use with the type of produce, meat, or poultry contained within the bag, or any other type of usable printable information.

In addition, the bottom layer can be printed on both sides as well. The bottom layer, obviously, remains attached to the bag or product, even after the top layer has been peeled off. The bottom layer may have pricing information, such as sell-by dates, lot code, recipes, bar codes, handling and cooking information, UPC codes, product or customer branding, or any other type of information that needs to stay with the product.

It is, therefore, the principle object of this invention to provide a separable tag for bags or other containers, wherein one layer of the tag may be peeled free, for use for coupons, manufacturer's rebates, and the like.

Still another object of this invention is to provide a tag in which a variety of indicia or other information can be provided thereon, either on a top peel-free layer, or on a bottom layer that is permanently affixed to the bag.

Still another object of this invention is to provide a shaped tag that can be readily stapled or tied to the neck of a bag or other container.

Yet another object of this invention is to provide a tag in which a variety of information can be applied thereto, and even have a too layer that may be peeled free, exposing additional indicia or information on the top side of the bottom layer even after the peeled layer has been removed.

Yet another object of this invention is to provide a convenient tag, formed having a body portion, with a narrower neck portion, that may be readily applied either manually or by machinery to the twisted neck of a closed bag.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
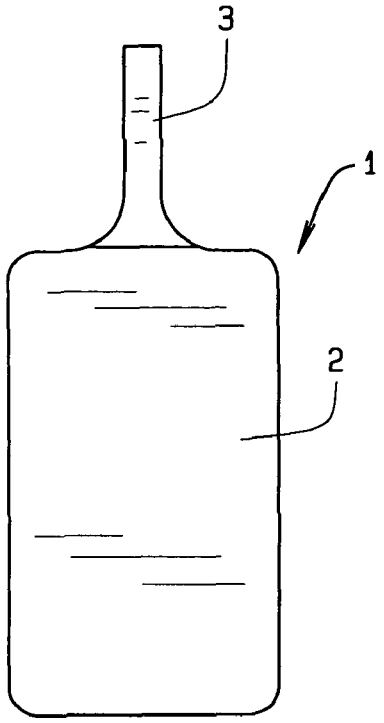
FIG. 1 is a plan view of one of the tags of this invention.

In referring to drawings, FIG. 1 shows the separable tag 1 for use upon bags or other containers. The tag includes a body portion 2, with a narrowed but integral neck portion 3, and as can be understood, the neck portion may be stapled, crimped, wire tied, or clipped to the upper end of a bag B, once vegetables or other produce have been enclosed therein. See FIG. 5.

The tag is made of a bottom layer 4, that extends throughout the length of the series of tags, as they are stamped or cut from a roll, so that a series of the tags, continuously, may be formed into a roll configuration, and unwound therefrom, during usage, either when manually or by machine applied to the produce bags, during their application. In addition, the neck portion 3 of the bottom layer 4 is continuous, so that the entire tag includes integrally the base or bottom portion 4, and its integral neck, as can be understood. This bottom layer may be formed of paper, plastic, or other synthetic printable material. The bottom layer has a release coat or a polymer adhesive applied thereto. This is a form of varnish that allows for the easy peel off of a top layer, as shown at 5 and for reasons to be described. The release coat may be ultraviolet silicon that is cured with an ultraviolet lamp, once applied, so as to provide the tackiness when laminating the top and bottom layers together, during fabrication of the tags, and before they are stamped or cut into the tag configuration, as noted. The top layer can also be made of a paper, or film, such a polypropylene, polyethylene, polystyrene, PVC, et ceterra, information. If paper is used on the top layer, then the adhesive to be applied will be a dry release type of adhesive. The dry release type of adhesive may be made by Northwest Coatings, under formula 20,000 C. If a polymer film or the like is used as the top layer, then a repositionable adhesive is used, such as the Northwest Coatings formula 21,833 B. Both of these types of adhesives are available upon the market from this company. Northwest Coatings in located in Oak Creek, Wis. Other types of adhesives, that quickly allow for the peel-off of an upper layer, are readily available and known in the art.

The purpose of the upper peelable layer 5 is to provide a peel-off portion for the tag, which may function as a coupon, manufacturer's rebate, cross branding, provide recipe information, or promotional advertisement, as can be understood. The underside of the bottom layer 4 may also contain various types of indicia, such as pricing information, sell-by date, lot code, recipes, handling, cooking information, UPC code, product or customer branding, or any other information that needs to stay with the product, as marketed. It is even just as likely that the upper surface 6 of the bottom layer may likewise contain further printed indicia, before any adhesive is applied thereto, so that when the upper layer 5 is peeled off, information will yet be available for viewing upon the surface 6, as can be understood. Thus, the concept of this invention is to provide multiple layers, from a peel-off tag, and a variety of surfaces, upon which various types of information can be applied, as desired and required by the merchandiser.

Figure 2:
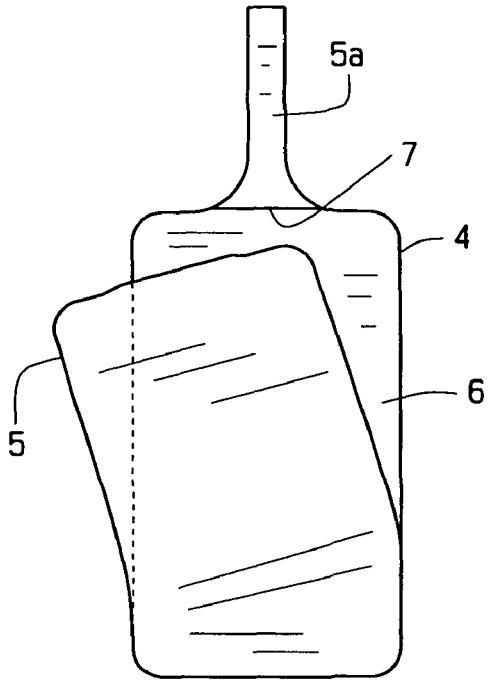
FIG. 2 shows the tag of FIG. 1, with its peelable upper layer partially removed.

As can also be seen in FIG. 2, a line of severance is made upon the upper layer 5, so that the upper layer portion as at 5*a*, applied to the neck 3 of the tag, will remain in place, but that a severable line, as at 7 provides for separation between the neck upper layer, and at peelable layer 5, as can be seen.

Figure 3:
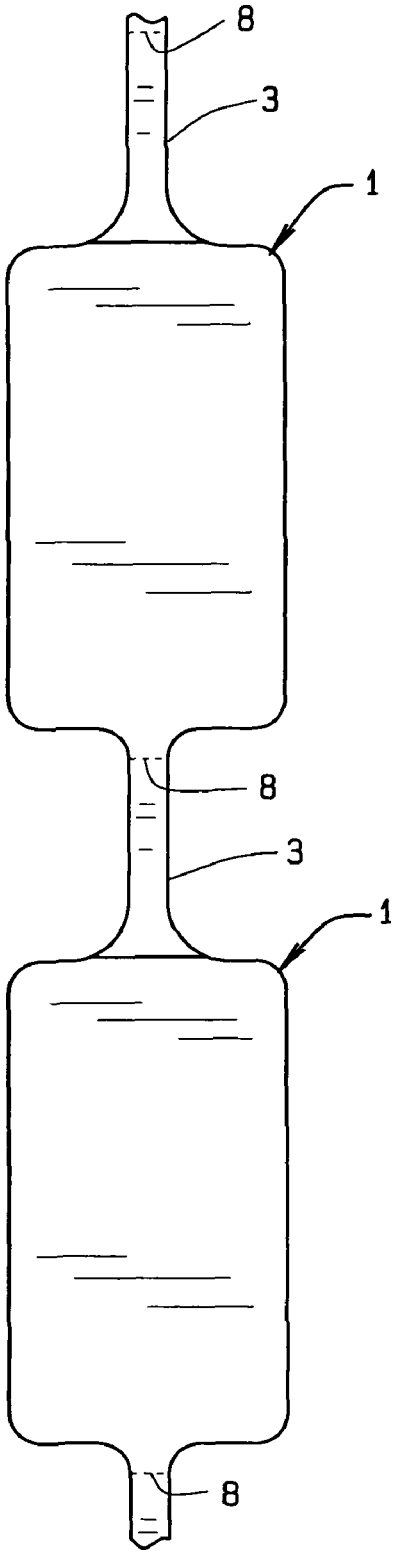
FIG. 3 shows a series of the tags, as manufactured, as pulled from a roll.

As can be noted in FIG. 3, the tags 1 can be formed continuously, so that they may be formed from a roll of sheet material, formed having the various layers as identified herein. Then, the tags will be cut to the configuration as shown in FIG. 3. During that process, there will be a line of perforation formed between each of the tags, as at the upper end of each neck 3, as at 8, so that each of the tags can be separated, one from another, as they are applied to the bagged vegetables or produce, meats, or poultry, during usage, either manually, or by machine. In addition, as each tag is being formed, its printed indicia may be applied thereto, upon the variety of surfaces as previously reviewed, so that the tags, as provided upon a toll, and supplied to the merchandiser, can have all the information readily applied thereto, in preparation for marketing. Or, the merchandiser themselves can print various information onto the tags, as desired. But, usually, coupon type information will have been previously printed, as the tags are being formed, usually through quality printing processes, so as to enhance the appearance of the tags, and the products to which the tags are applied, in preparation for marketing.

Figure 5:
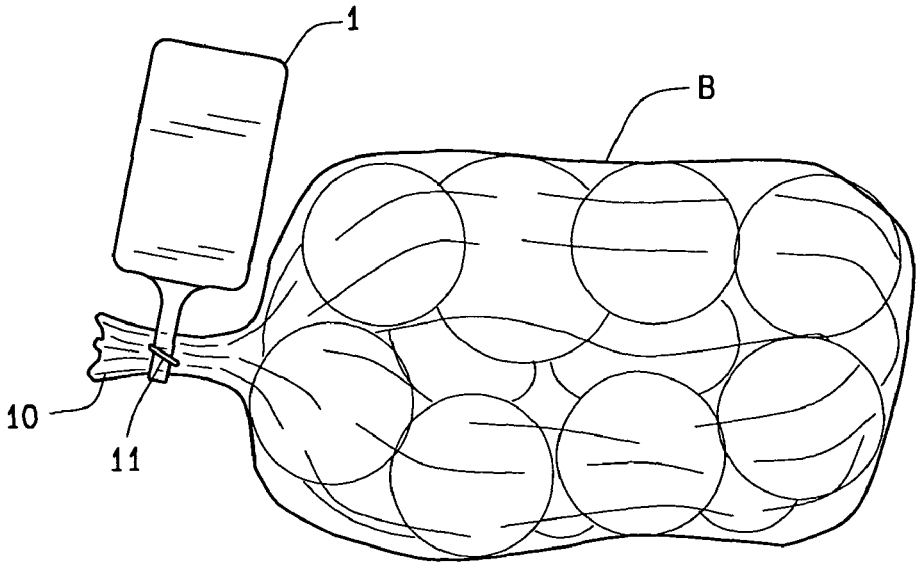
FIG. 5 shows the tag of this invention as stapled to the upper crimped neck of a poultry, meat, produce, or other vegetable, bag.
Figure 4:
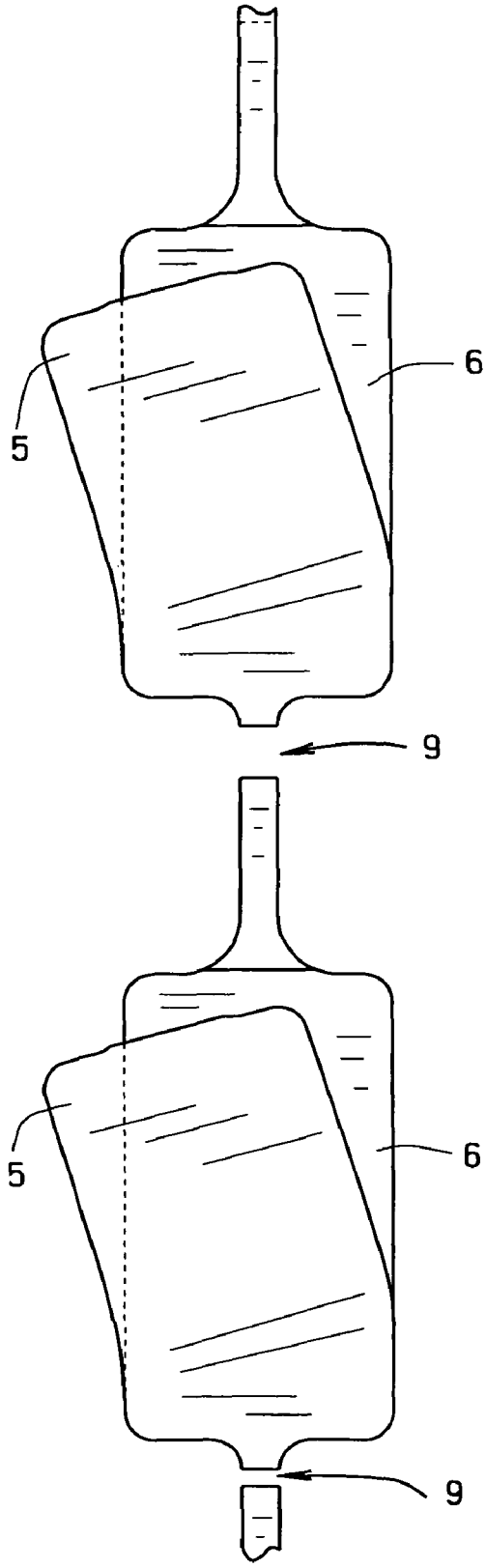
FIG. 4 shows the tags of FIG. 3, being separated along their line of perforation, and with the top layers being partially peeled away.

FIG. 4 shows how a series of the tags are separable, as can be seen at 9, as they are being used and applied to the product packaging, in the manner as shown in FIG. 5. Also, as can be seen, each tag will have its peelable portion or layer 5 as can be noted.

As can be further understood, the peelable portions or layers 5 may be semi-transparent, so that the coupon or other information applied thereto can be coordinated with the print material furnished upon the upper surface 6 of each tag, so as to furnish a semi-three dimensional or holographic appearance to each tag, to add to its attractiveness.

As can further be seen in FIG. 5, each of the tags, when applied to a bag, will be stapled, clipped, wire tied, or otherwise attached, or even heat sealed, to the twisted upper end 10 of each bag, during packaging of the food product. As an example, a staple 11 pulls the tag 1, to the upper end 10 of the bag, as can be noted in FIG. 5.

Variations or modifications to the subject matter of this invention may occur to those skilled in the art upon review of the disclosure as provided herein. Such variations, if within the spirit of this development, are intended to be encompassed within the scope of the invention as disclosed herein. The description of the preferred embodiment, as shown in the drawings, is set forth for illustrative purposes only.

I claim:

1. Separable tags for bags or other containers and for use as coupons, manufacture's rebates, cross branding, recipes, and promotional advertisements, and comprising a series of tags, each said tag having upper and bottom layers, said bottom layer extends throughout the length of the tag, and said bottom layer including a bottom portion, and having a neck portion extending integrally upwardly therefrom, said series of tags being linked together but capable of being separated for individual usage at the top of each integral neck, said series of tags are separable at their upper neck portions by a line of perforations, each tag capable of being connected to a bag or other container during usage, the integral neck being substantially narrower than the tag bottom portion to facilitate its connection to a bag or other container, said integral neck extending upwardly from said bottom portion approximately centrally thereof, the upper layer of said tag overlying both the bottom portion and the integral neck of said tag, said upper layer being adhered to the bottom portion by an adhesive whereby the upper layer being separable from said bottom portion of the tag during usage, said adhesive comprising a release coat, and said adhesive being one of ultraviolet silicone, release type adhesive, release coat, and a polymer adhesive, the upper layer of each tag being made of one of paper, polymer film, polypropylene, polyethylene, polystyrene, and polyvinylchloride film, the bottom layer of said tag and its integral neck being formed of one of paper, plastic, polymer film, polypropylene, polyethylene, polystyrene, and polyvinylchloride film and other synthetic printable material, the upper layer and the bottom portion of the bottom layer of each tag capable of being printed to provide for the disclosure of indicia upon the exposed surfaces of said layers of each formed tag, the upper layer of each tag can be peeled from the bottom layer, the upper layer remains adhered to the neck while the upper layer on the bottom portion capable of being separated therefrom, and there being a line of separation between the upper layer provided on the neck and the releasable upper layer of the tag at the bottom portion, wherein said series of tags being connected together continuously for forming a roll of said tags, and the upper layer of the tag and the bottom portion of the bottom layer of each tag capable of being printed to provide for the disclosure of indicia upon the exposed surfaces of said layers of each formed tag, and the neck portion and bottom portion of the upper layer of each tag capable of individual separation from the bottom layer of said tags.

2. The separable tags of claim 1 wherein the separable upper layer of the bottom portion of the tag is capable of being imprinted with coupon information, manufacturer rebate information, cross branding, recipe information, and promotional advertising.

3. The separable tags of claim 1 wherein the bottom layer of the bottom portion of each the tag may be imprinted with pricing information, sale-by date, lot code, recipes, handling information, cooking instructions, UPC code, and product and customer branding indicia.

* * * * *